US011491791B2

(12) United States Patent
Kimura

(10) Patent No.: US 11,491,791 B2
(45) Date of Patent: Nov. 8, 2022

(54) CLEANING DEVICE AND LIQUID DISCHARGE RECORDING APPARATUS

(71) Applicant: TOSHIBA TEC KABUSHIKI KAISHA, Tokyo (JP)

(72) Inventor: Kazuhisa Kimura, Hiratsuka Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 60 days.

(21) Appl. No.: 16/921,656

(22) Filed: Jul. 6, 2020

(65) Prior Publication Data

US 2021/0070052 A1 Mar. 11, 2021

(30) Foreign Application Priority Data

Sep. 6, 2019 (JP) ..... JP2019-163387

(51) Int. Cl.
*B41J 2/165* (2006.01)

(52) U.S. Cl.
CPC ..... *B41J 2/16535* (2013.01); *B41J 2/16505* (2013.01); *B41J 2/16538* (2013.01); *B41J 2002/16502* (2013.01); *B41J 2002/16514* (2013.01)

(58) Field of Classification Search
CPC ..... B41J 2/16535; B41J 2/16505; B41J 2/16538; B41J 2002/16502; B41J 2002/16514; B41J 2002/16597; B41J 2/16532
See application file for complete search history.

(56) References Cited

U.S. PATENT DOCUMENTS

| | | | | |
|---|---|---|---|---|
| 7,490,921 | B2 * | 2/2009 | Hashi | B41J 2/16532 347/29 |
| 9,080,728 | B2 | 7/2015 | Fukada et al. | |
| 9,168,753 | B2 | 10/2015 | Miyazawa | |
| 2008/0238990 | A1 | 10/2008 | Inoue | |
| 2008/0286021 | A1 | 11/2008 | Asami | |
| 2009/0141073 | A1 | 6/2009 | Umeda | |

(Continued)

FOREIGN PATENT DOCUMENTS

| | | | |
|---|---|---|---|
| CN | 103370202 | A | 10/2013 |
| CN | 103796836 | A | 5/2014 |

(Continued)

OTHER PUBLICATIONS

Extended European Search Report dated Feb. 10, 2021, mailed in counterpart European Application No. 20190154.3, 8 pages.

(Continued)

*Primary Examiner* — Geoffrey S Mruk
(74) *Attorney, Agent, or Firm* — Kim & Stewart LLP

(57) ABSTRACT

According to one embodiment, a cleaning device comprises a suction port portion, a guide portion, and an urging member. The suction port portion is configured to face a nozzle plate of a liquid discharge head at a predetermined gap distance between the suction port and the nozzle plate. The guide portion is configured to face a cover mask of the liquid discharge head and is moveable in a direction away from the cover mask. The cover mask covers a periphery of a surface of the nozzle plate. The urging member is configured to urge the guide portion toward the cover mask.

19 Claims, 7 Drawing Sheets

(56) References Cited

U.S. PATENT DOCUMENTS

| | | | |
|---|---|---|---|
| 2012/0299996 | A1 | 11/2012 | Kano et al. |
| 2018/0272717 | A1 | 9/2018 | Kimura |

FOREIGN PATENT DOCUMENTS

| | | | |
|---|---|---|---|
| EP | 3450177 | A1 | 3/2019 |
| JP | H05201028 | A | 8/1993 |
| JP | 2015027660 | A | 2/2015 |
| JP | 2017019153 | A | 1/2017 |

OTHER PUBLICATIONS

Chinese Office Action dated Mar. 16, 2022, mailed in counterpart Chinese Application No. 202010627375.6, 17 pages (with translation).

* cited by examiner

CLEANING DEVICE AND LIQUID DISCHARGE RECORDING APPARATUS

CROSS-REFERENCE TO RELATED APPLICATIONS

This application is based upon and claims the benefit of priority from Japanese Patent Application No. 2019-163387, filed on Sep. 6, 2019, the entire contents of which are incorporated herein by reference.

FIELD

Embodiments described herein relate generally to a cleaning device and a liquid discharge recording apparatus.

BACKGROUND

A liquid discharge recording apparatus, such as an ink jet type printer, that selectively discharges droplets onto a recording medium from nozzles on a nozzle plate is known. Such a liquid discharge recording apparatus comprises a cleaning device for removing unwanted, residual deposits, such as liquid and paper dust, adhered to the periphery of the nozzles.

In one known method, a wiping blade is provided as a cleaning device for wiping a surface of the nozzle plate=. However, when the wiping blade wipes the nozzle plate, residual deposits on the nozzle plate may be pushed into nozzle holes.

There is also known method that uses a suction nozzle as a cleaning device. The suction nozzle has a suction port facing a plurality of nozzle rows and sucks the residual deposits left on the nozzle plate while moving along the direction of the nozzle row. The suction nozzle utilizes the flow of air near the surface of the nozzle plate to collect the residual deposits from the surface of the nozzle plate. However, when the residual deposits are as liquid that has dried and accumulated over time to become strongly adhered on portions of the nozzle plate, such as a peripheral cover mask, the suction nozzle sliding over the accumulated residue deposits on the cover mask may cause a larger than optimal gap to be left between the suction nozzle and the nozzle plate. This may cause unsuitable suction of the residual deposits from the nozzle plate resulting in poor cleaning results.

Hence, there is a need for a cleaning device for a liquid discharge recording apparatus capable of suitably removing residual deposits that might become adhered to a nozzle plate.

DETAILED DESCRIPTION

Figure 1:
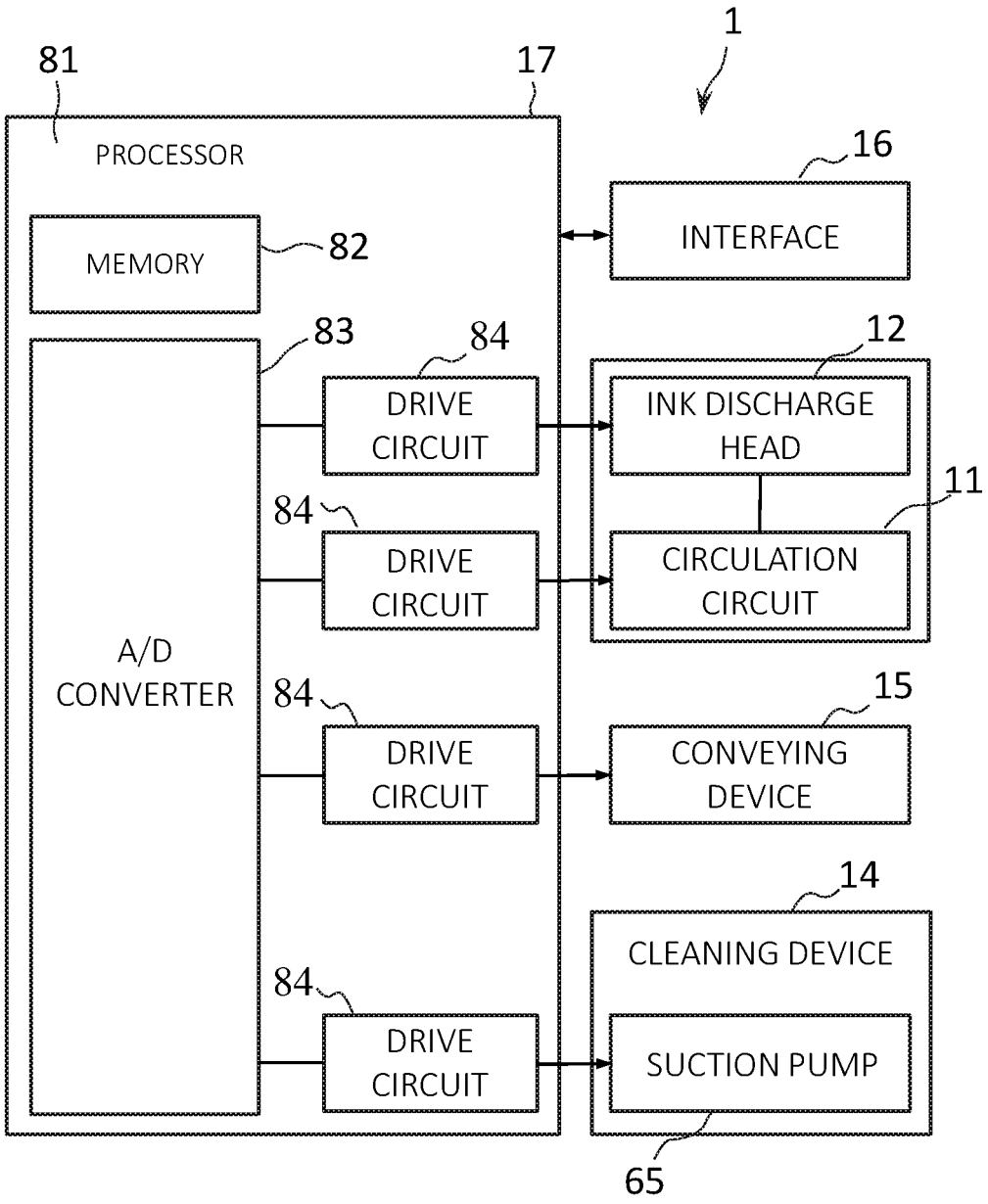
FIG. 1 is a block diagram of a liquid discharge recording apparatus according to an embodiment.

According to one embodiment, a cleaning device comprises a suction port portion, a guide portion, and an urging member. The suction port portion is configured to face a nozzle plate of a liquid discharge head at a predetermined gap distance between the suction port and the nozzle plate. The guide portion is configured to face a cover mask of the liquid discharge head and is moveable in a direction away from the cover mask. The cover mask covers a periphery of a surface of the nozzle plate. The urging member is configured to urge the guide portion toward the cover mask.

Hereinafter, certain example embodiments of a liquid discharge recording apparatus 1 and a cleaning device 14 will be described with reference to FIGS. 1 to 7. For the purpose of explanation in the drawings, depicted elements and/or aspects are not necessarily to scale, such that each depicted element and/or aspect can be shown as enlarged, reduced as appropriate. Additionally, the drawings are, in general, schematic such that, in some illustrations, elements and/or aspects may be omitted for purposes of description.

Figure 2:
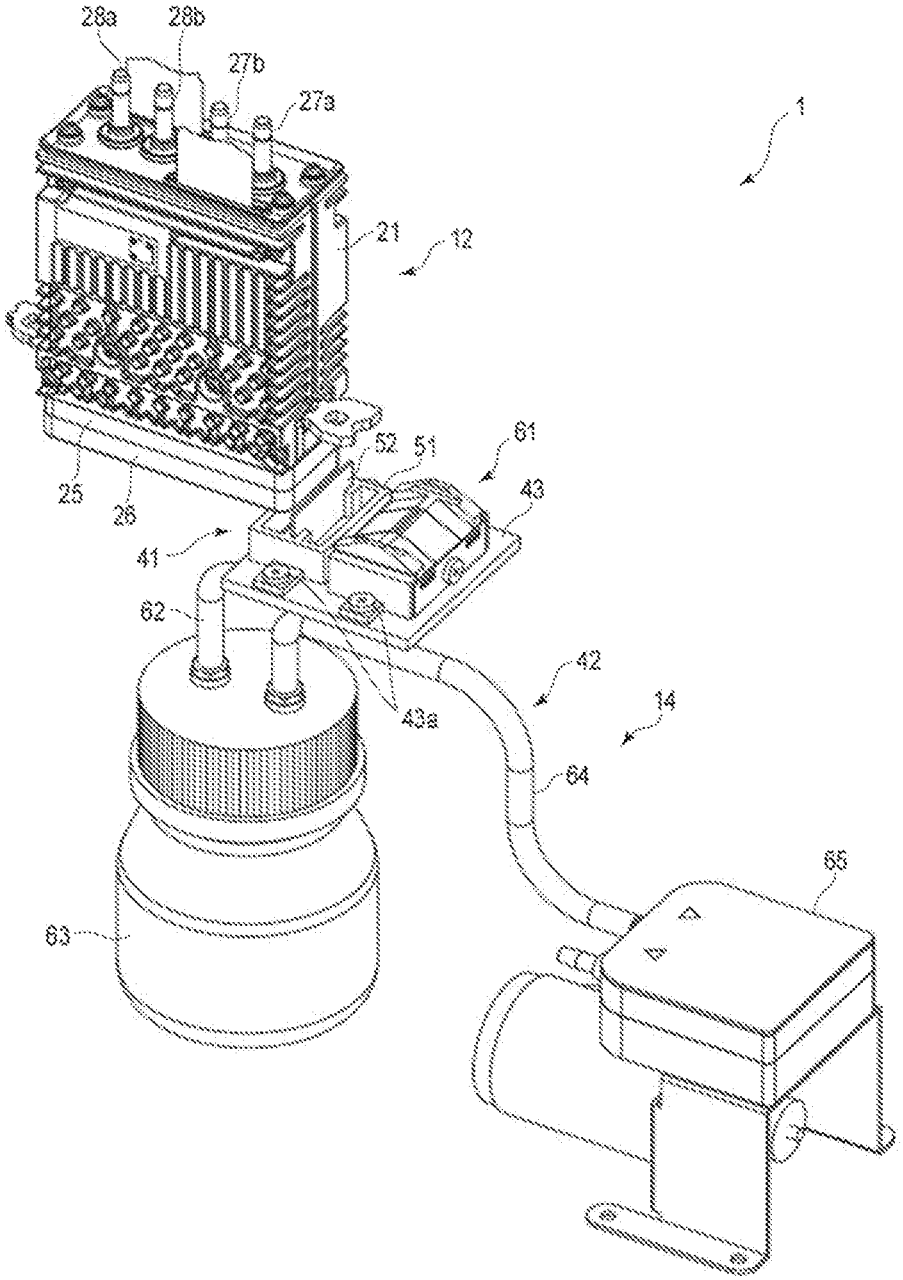
FIG. 2 depicts a liquid discharge recording apparatus according to an embodiment.
Figure 3:
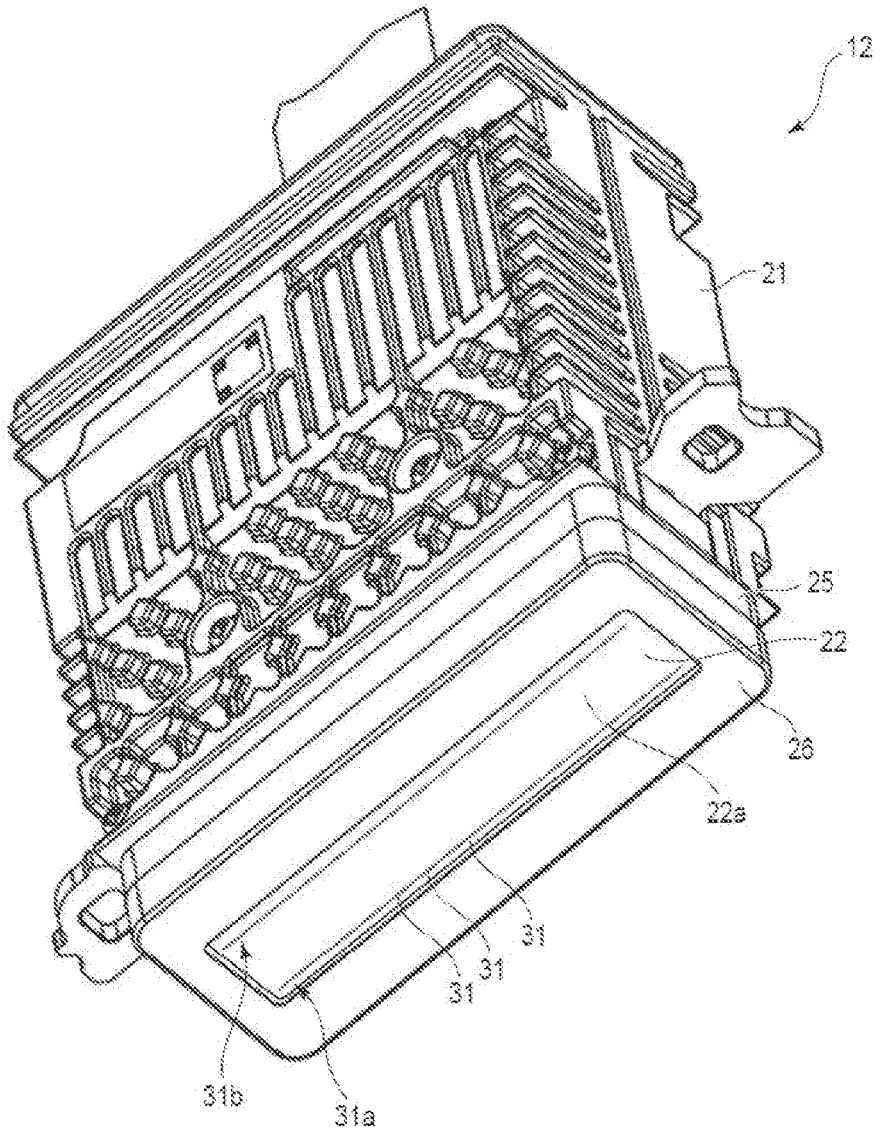
FIG. 3 depicts a configuration of a liquid discharge head of a liquid discharge recording apparatus according to an embodiment.
Figure 4:
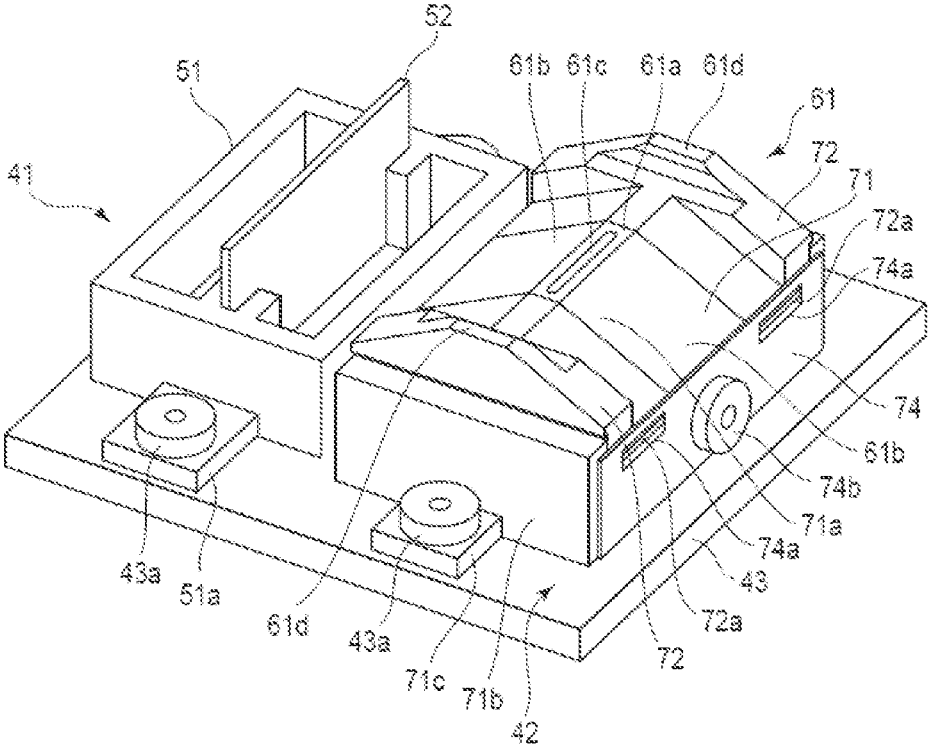
FIG. 4 depicts a configuration of a cleaning device of a liquid discharge recording apparatus in a perspective view according to an embodiment.
Figure 5:
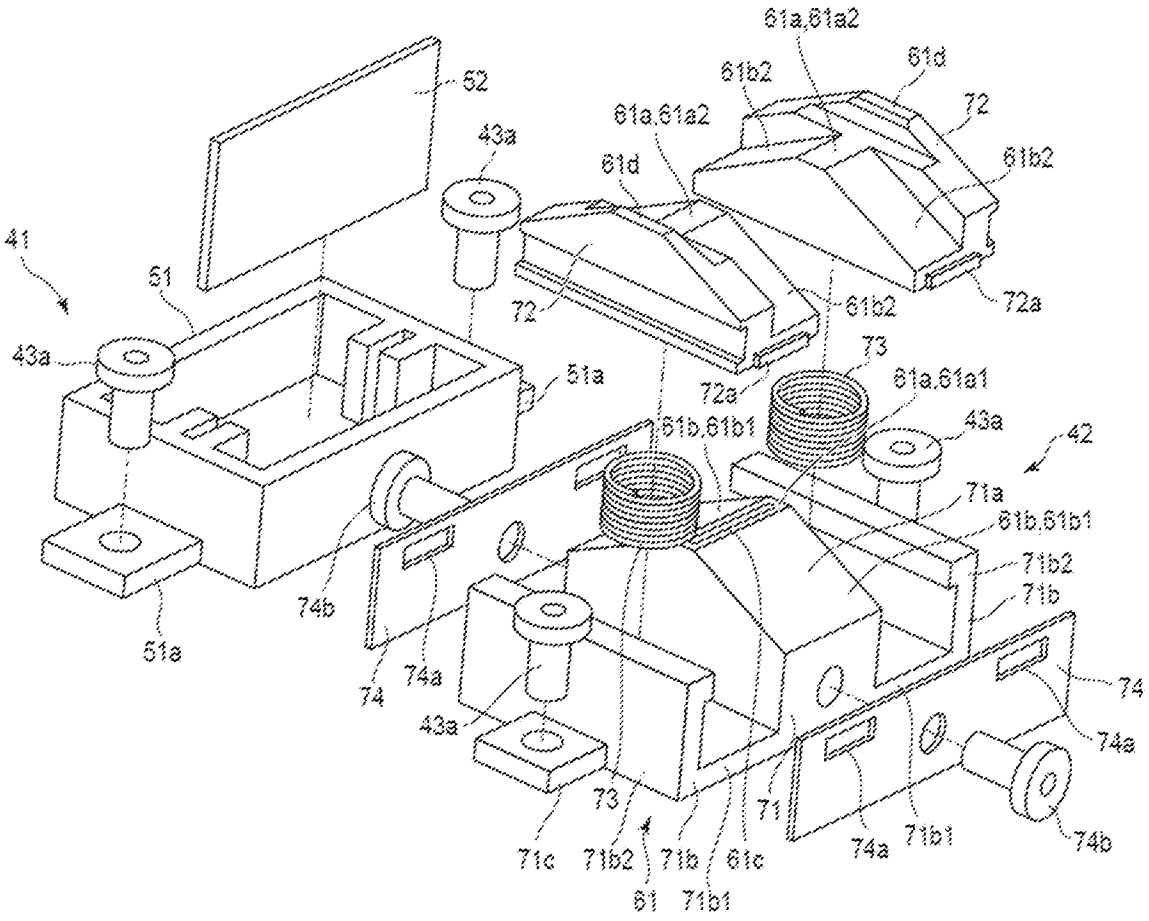
FIG. 5 depicts a configuration of a cleaning device of a liquid discharge recording apparatus in an exploded perspective view according to an embodiment.
Figure 6:
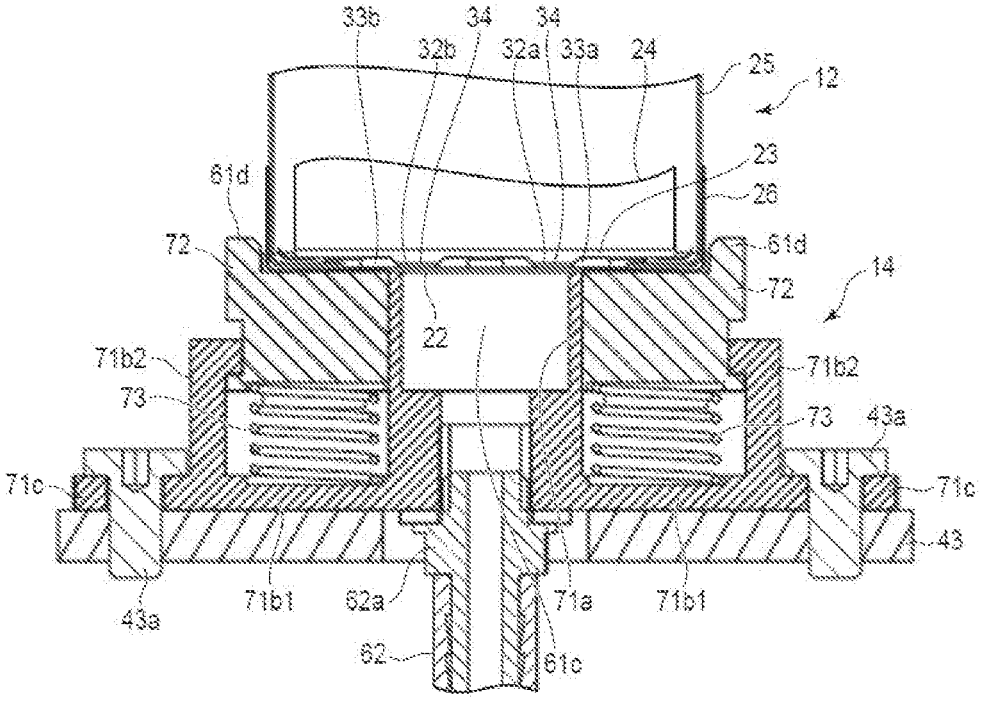
FIG. 6 depicts a configuration of a suction device of a cleaning device in a cross sectional view according to an embodiment.
Figure 7:
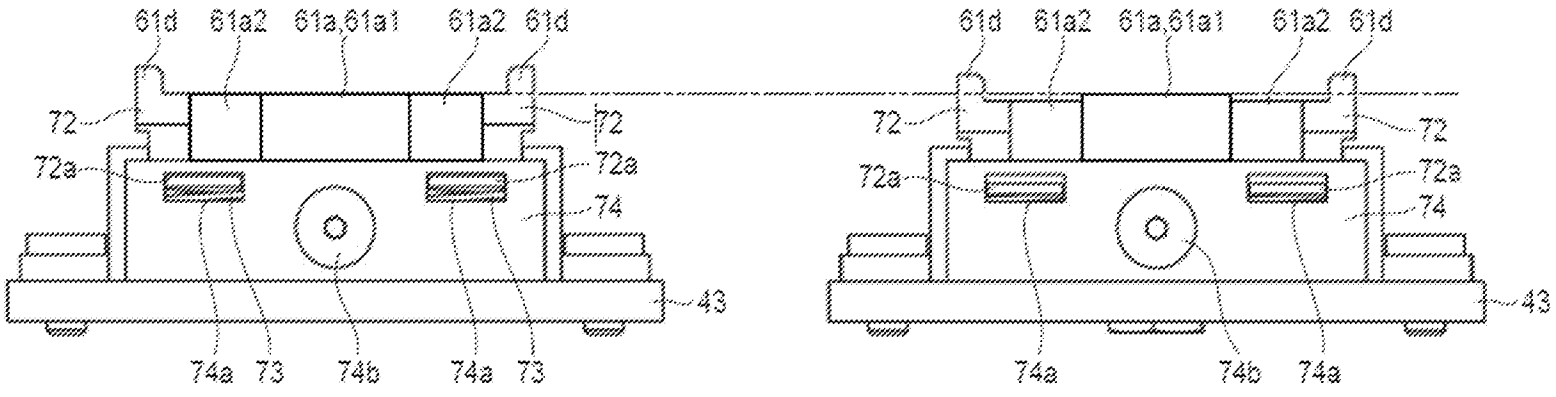
FIG. 7 depicts aspects of an operation of a suction device according to an embodiment.

FIG. 1 is a block diagram showing the configuration of the liquid discharge recording apparatus 1. FIG. 2 is a perspective view showing the configuration of the liquid discharge head 12 and cleaning device 14 of the liquid discharge recording apparatus 1. FIG. 3 is a perspective view illustrating the configuration of the liquid discharge head 12. FIG. 4 is a perspective view showing the configuration of the cleaning device 14, according to one or more embodiments. FIG. 5 is an exploded perspective view showing the configuration of the cleaning device 14. FIG. 6 is a perspective view showing the configuration of the suction device 42 of the cleaning device 14. FIG. 7 is an explanatory diagram for describing an example of certain operations according to the presence or absence of foreign matter on the cover mask 26 of the liquid discharge head 12.

In the example embodiments, a liquid discharge recording apparatus 1 will be described as an ink jet recording apparatus that discharges ink, but the present disclosure is not limited to this example. As shown in FIGS. 1 and 2, the liquid discharge recording apparatus 1 includes a circulation circuit 11, a liquid discharge head 12, a cleaning device 14, a conveying device 15, an interface 16, and a controller 17.

The circulation circuit 11 is connected to the liquid discharge head 12. In one embodiment, the circulation circuit comprises a circulation path connected to the liquid discharge head 12, an ink tank that contains ink and is connected to the circulation path, and a circulation pump for circulating ink along the circulation path. The circulation path forms a flow path through the ink tank and the liquid discharge head 12. The circulation pump supplies the ink in the ink tank to the liquid discharge head 12 and returns the ink that has not been discharged at the liquid discharge head 12 to the ink tank. The circulation pump is, for example, connected to the controller 17.

The liquid discharge head 12 may be, for example, a circulation type head through which ink from the ink tank circulates then returns to ink tank if not discharged from the liquid discharge head 12. The liquid discharge head 12 discharges the ink as a liquid to a recording medium disposed opposite thereto and forms a desired image on the recording medium. The recording medium may be, for example, a sheet of paper.

As shown in FIGS. 2, 3 and 6, the liquid discharge head 12 includes a housing 21, a nozzle plate 22, a base plate 23, a manifold 24, a mask plate 25, a cover mask 26, a pair of supply pipes 27*a* and 27*b*, and a pair of collection pipes 28*a* and 28*b*. The nozzle plate 22 and the base plate 23 may be referred to collectively as a liquid discharge portion.

The nozzle plate 22 has a rectangular plate shape. The nozzle plate 22 has, for example, two nozzle rows 31*a* and 31*b*, each having a plurality of nozzle holes 31 arranged in a first direction. In the present embodiment, the arrangement direction of the nozzle holes 31 in the respective nozzle rows 31*a* and 31*b* is the first direction. A direction that runs along a nozzle surface 22*a* (which is the outward facing surface of the nozzle plate 22) and that is perpendicular to the first direction is the second direction. The direction orthogonal to both the first direction and the second direction is the third direction.

The base plate 23, a part of the liquid discharging portion of the liquid discharge head 12, is disposed opposite to the printing surface side of the nozzle plate 22 and is supported by the mask plate 25. The base plate 23 includes, for example, a plurality of first pressure chambers 32*a* configured to communicate with nozzle holes 31 of the first nozzle row 31*a* of the nozzle plate 22, a plurality of second pressure chambers 32*b* disposed opposite to the nozzle holes 31 of the second nozzle row 31*b*, a first common chamber 33*a* communicating with the plurality of the first pressure chambers 32*a*, and a second common chamber 33*b* communicating with the second pressure chambers 32*b*.

The base plate 23 has an actuator 34 at a portion facing each of the pressure chambers 32*a* and 32*b*. The actuator 34 includes, for example, a piezoelectric diaphragm in which a piezoelectric element and a diaphragm are laminated. The piezoelectric element is made of, for example, a piezoelectric ceramic material such as PZT (lead zirconate titanate) or the like. The base plate 23 has an electrode formed facing the pressure chamber. The electrode is electrically connected to a wiring pattern on a circuit board.

The manifold 24 is configured in a rectangular block shape and is joined to the base plate 23. The manifold 24 has channels communicating with the common chambers 33*a* and 33*b* to form ink channels.

The mask plate 25 is a frame constituting a part of the housing 21, and the mask plate 25 covers at least a part of an outer peripheral surface of the manifold 24.

The cover mask 26 is a cover that covers an outer peripheral edge portion on the nozzle surface 22*a* side of an outer surface of the nozzle plate 22 and a part of the outer peripheral surface of the mask plate 25. The thickness of the cover mask 26 creates a predetermined gap between the nozzle surface 22*a* and the suction surface 61*a* of the cleaning device 14 to allow air to flow therethrough.

The supply pipes 27*a* and 27*b* are tubular members forming a portion of a flow path communicating with the upstream side of a pair of flow paths from the ink tank. By the operation of a circulation pump or the like, the liquid in the ink tank is supplied through the supply pipes 27*a* and 27*b*. The types of liquids supplied via the supply pipes 27*a* and 27*b* may be the same or different from one another.

The collection pipes 28*a* and 28*b* are tubular members forming a portion of a flow path communicating with the downstream side of a pair of flow paths from the liquid discharge head 12 to the ink tank. The operation of a circulation pump or the like causes liquid to from the liquid discharge head 12 through the collection pipes 28*a* and 28*b* back to the ink tank.

As shown in FIGS. 2, 4 and 6, the cleaning device 14 includes a wiping device 41, a suction device 42, and a holding member 43.

The wiping device 41 includes a holder 51 and a wiping blade 52.

The holder 51 is held at the holding member 43. The holder 51 holds the wiping blade 52. The holder 51 has a flange 51*a* which is secured to the holding member 43 by a fastening member 43*a* such as a bolt.

The wiping blade 52 is made of an elastically deformable resin material such as rubber. The wiping blade 52 is formed in a rectangular plate shape. The wiping blade 52 is held in the holder 51 in a posture at which it is angled toward the liquid discharge head 12. In one embodiment, the wiping blade 52 is held in the holder 51 with the width direction of the wiping blade 51 aligning in a direction orthogonal to the arrangement direction of the plurality of nozzle holes 31 of the two nozzle rows 31*a* and 31*b*, that is the second direction. The main direction of the wiping blade 51 is along the third direction perpendicular to the first direction and the second direction, that is the direction opposite to the nozzle plate 22 of the liquid discharge head 12 when the cleaning device 14 is positioned facing the liquid discharge head 12.

The wiping blade 52 abuts against the cover mask 26 to wipe off residue from the cover mask 26. The wiping blade 52 deforms to a curved shape when it comes into contact with the cover mask 26 so that the wiping blade 52 can be moved in close contact with the surface of the cover mask 26. The wiping blade 52 is not in contact with the nozzle plate 22 when it wipes the cover mask 26. The wiping blade 52 wipes only the surface of the cover mask 26 rather than the surface of the nozzle plate 22 itself.

The suction device 42 is held by the holding member 43 in the first direction, that is, in the arrangement direction of the plurality of nozzle holes 31, side by side with the wiping device 41. The suction device 42 comprises a suction head 61, a suction tube 62 connected to the suction head 61, a bottle 63 connected to the suction head 61 via the suction tube 62, a connecting tube 64 connected to the bottle 63, and a suction pump 65 which is a suction mechanism connected to the bottle 63 via the connecting tube 64.

The suction head 61 includes a suction surface 61*a* configured to face the liquid discharge head 12 when placed against the liquid discharge head 12 and a pair of inclined surfaces 61*b* inclined from the suction surface 61*a* in a direction away from the liquid discharge head 12. Each inclined surface 61*b* is to one side of the suction surface 61*a*. A suction port (also referred to as a suction nozzle) 61*c* is provided in the suction surface 61*a*. A guide surface portion 61*d* is provided at each end of the suction head 61 in the second direction.

The suction surface 61*a* is in a plane parallel to the nozzle surface 22*a*. The suction surface 61*a* is provided with an opening for a suction port 61*c* in its the center. The suction port 61*c* is an elongated hole configured to face the nozzle holes 31 when placed against the liquid discharge head 12. The nozzle holes 31 are arranged in the second direction of the two nozzle rows 31*a* and 31*b* on the nozzle plate 22. The pair of guide surface portions 61*d* engage with edges of the cover mask 26 to guide a position in the second direction with respect to the liquid discharge head 12 and the suction head 61.

The suction head 61 faces the nozzle surface 22*a* in such a manner that a center portion (central portion 71) of the suction head 61 maintains a gap for air flow with the nozzle surface 22*a*. The central portion 71 of the suction head 61 includes the suction surface 61*a*. The suction surface 61*a* includes the suction port 61*c* and directly faces the nozzle plate 22 when placed against the liquid discharge head 12. Furthermore, the suction head 61 is provided with a pair of guides 72. The guide surface portions 61*d* are an upper surface of each of the guides 72 and are in a different plane than the suction surface 61*a*. The suction head 61 can move in the third direction and the guide surface portions 61*d* at each end of the suction head 61 in the second direction face the cover mask 26 and can come into contact with the outer surface of the cover mask 26.

In this configuration, the suction surface 61*a* is maintained at a position in the third direction at which the region facing the nozzle surface 22*a* is at a predetermined gap distance from the nozzle surface 22*a* when the regions facing the cover mask 26 are brought into contact with the outer face area of the cover mask 26.

In one embodiment, the suction head 61 includes at least one suction port 61*c*, at least one guide 72, at least one urging member 73, and at least one stopper 74.

The central portion 71 has a generally rectangular shape and includes a base portion 71*a*. The base portion 71*a* has an upper surface which faces the nozzle surface 22*a*. The central portion 71 has a pair of support portions 71*b* which support the pair of guide portions 72. An urging member 73 contacts each of the guide portions 72. A flange 71*c* is provided on each of the support portions 71*b*. The flanges 71*c* can be used to fix the central portion 71 to the holding member 43. The base portion 71*a*, the support portions 71*b*, and the flanges 71*c* are formed integrally with each other in this example.

The base portion 71*a* forms a portion 61*a*1 of the suction surface 61*a* and a portion 61*b*1 of each of the inclined surfaces 61*b*. The base portion 71*a* has, within its internal volume, the suction port 61*c* and a channel connecting to the suction tube 62 via, for example, a pipe fitting 62*a*, also referred to as a tube fitting 62*a* in some contexts.

The support portion 71*b* movably supports the guide portion 72 and urging member 73. The support portion 71*b* includes, for example, a bottom wall 71*b*1 that supports the urging member 73 and a side wall 71*b*2 that is spaced apart from the base portion 71*a* in the second direction. The bottom wall 71*b*1 extends in a plane along the first and second directions and supports the urging member 73. The side wall 71*b*2 positions the guide portion 72 and the urging member 73 between the base portion 71*a* and the side wall 71*b*2 and restricts the movement toward the outside in the second direction.

Each of the flanges 71*c* is, for example, integrally formed with the bottom wall 71*b*1 and fixed to the holding member 43 by a fastening member 43*a* such as a bolt.

The pair of guide portions 72 are disposed between the base portion 71*a* and the side walls 71*b*2, respectively. Each guide portion 72 forms a part of portion 61*a*2 of the suction surface 61*a* and a part of portion 61*b*2 of the end side of the pair of inclined surfaces 61*b* in the second direction. In one embodiment, the top surface of the guide portion 72 defines the suction surface 61*a* and the pair of inclined surfaces 61*b* in the region opposite to the cover mask 26 when facing the liquid discharge head 12.

Each guide portion 72 includes a guide surface portion 61*d*. Further, the guide portion 72 has protrusions 72*a* on both side surfaces in the second direction. Each protrusion 72*a* may have a rectangular columnar shape or a cylindrical shape. In the present embodiment, the protrusion 72*a* is formed in a rectangular columnar shape having the width in the second direction larger than the width in the third direction.

The urging member 73 is, for example, a coil spring or other pressing mechanism. An urging member 73 is provided on each of the bottom walls 71*b*1.

The stopper 74 can move backward and forward in the third direction of the pair of guide portions 72 and regulates an upward movement position of the pair of guide portions 72 in the third direction. The stopper 74 prevents the pair of guide portions 72 and the pair of urging members 73 from falling out from the opening between the base portion 71*a* and the pair of the side walls 71*b*2.

The stopper 74 is formed in a rectangular plate shape that covers between the pair of the side walls 71*b*2 in the second direction, for example. In one embodiment, a pair of stoppers 74 are provided to cover the suction port portion 71 in the first direction. Each stopper 74 covers the opening between the base portion 71*a* and the side wall 71*b*2. The stopper 74 has an opening 74*a* larger than the protrusion 72*a* in the third direction (that is the direction opposite to the cover mask 26 of the nozzle plate 22), allowing insertion of the protrusion 72*a* in the guide portion 72 and movement of the protrusion 72*a* in the third direction. The opening 74*a* is configured so that a position close to the outer surface of the cover mask 26 becomes a top dead center of the stopper 74. The stopper 74 is fixed to, for example, the base portion 71*a* by the fastening member 74*b*.

The suction tube 62 forms a flow path through which liquid aspirated at the suction head 61 is conveyed to the bottle 63. The bottle 63 is a collection container for collecting liquid suctioned from the suction head 61. The bottle 63 is made of a material which is resistant to the liquid to be collected.

The connecting tube 64 is positioned to be above the highest liquid level of the liquid to be collected by the bottle 63 at one end. The connecting tube 64 forms a flow path for the air in the bottle 63 to be removed by the suction pump 65.

The suction pump 65 is a pump for making the pressure inside of the bottle 63 negative relative to ambient pressure, for example, a diaphragm pump or the like can be used as the suction pump 65. The suction pump 65 includes a suction port and an exhaust port. The suction port of the suction pump 65 is connected to the connecting tube 64 and connected to the bottle 63 via the connecting tube 64. For example, the exhaust port of the suction pump 65 is always open.

The holding member 43 holds the holder 51 and the central portion 71 in parallel along the first direction. For example, the holding member 43 secures the holder 51 and the central portion 71 with the fastening member 43*a*.

The conveying device 15 (see FIG. 1) moves the liquid discharge head 12 and the cleaning device 14 relative to each other. For example, the conveying device 15 may include a moving mechanism supporting the holding member 43 to move the wiping device 41 and the suction head 61 between a standby position and a maintenance position. For example, the conveying device 15 in this example includes a recording medium moving mechanism for holding and transporting the recording medium, and a head moving mechanism for moving the liquid discharge head 12 at a predetermined time in accordance with various printing conditions.

The interface 16 (see FIG. 1) includes a power supply, a display device, and an input device. The interface 16 is connected to a processor 81, which functions as a control unit or controller of the liquid discharge recording apparatus.

The commands and/or inputs received via interface 16 instruct the processor 81 to perform various operations. That is, the input device of the interface 16 operates to permit the receiving of user inputs or the like. Under the control of the processor 81, the interface 16 can display various information and images on the display device.

The controller 17 (see FIG. 1) includes processor 81, memory 82 (for storing programs or various data), an A/D conversion unit 83 (which can be a circuit converting analog data (voltage values) into digital data (bit data)), a drive circuit 84 for driving various elements, and an amplification circuit.

The processor 81 comprises, for example, a central processing unit (CPU). The processor 81 controls each portion of the liquid discharge recording apparatus 1 to implement various functions in accordance with an operating system or an application program.

The processor 81 controls the operation of each part of the liquid discharge recording apparatus 1 via the drive circuit 84 which is connected to various driving mechanisms.

For example, the processor 81 controls the operation of the liquid discharge head 12 and a circulation pump to control the printing operation by executing a control process based on a control program recorded in the memory 82.

In a printing process for performing printing by ejecting liquid from the nozzle holes 31 according to one or more embodiments, when the processor 81 detects an input instructing the start of printing, the processor 81 controls the liquid discharging head 12 and the recording medium moving mechanism and head moving mechanism of the conveying device 15, moves the recording medium and the liquid discharging head 12 to a predetermined position, and causes the liquid discharge head 12 to execute the liquid-droplet ejection action(s).

The memory 82 is, for example, a nonvolatile memory and mounted in the controller 17. Various control programs and operating conditions (parameters) are stored in the memory 82 as necessary for the control of various operations such as ink circulation operations, ink supply operations, temperature control, liquid level management, and pressure management.

The operation of the liquid discharge recording apparatus 1 will now be described. First, the printing operation of the liquid discharge recording apparatus 1 will be described.

In the printing operation, the processor 81 detects, for example, a printing instruction entered by the user via the interface 16. When the printing instruction is detected, the processor 81 drives the recording medium moving mechanism to start conveying the recording medium. Further, the processor 81 drives the head moving mechanism to move the liquid discharge head 12 to a predetermined position corresponding to an image to be formed. The predetermined position faces the recording medium.

Then, the processor 81 drives the liquid discharge head 12 by outputting a printing signal to the liquid discharge head 12 at a predetermined timing. The liquid discharge head 12 selectively drives piezoelectric elements based on image signals corresponding to the image data for a discharge operation and discharges the ink from the nozzle holes 31 accordingly. Thus, an image is formed on the recording medium.

Next, cleaning operation of the liquid discharge recording apparatus 1 will be described. First, the processor 81 controls the movement mechanism of the conveying device 15 to move the holding member 43 in one direction. At this time, the processor 81 controls the movement mechanism so as to face the liquid discharge head 12 in the order to position the wiping device 41 and the suction device 42.

When the moving mechanism moves the holding member 43, the tip of the wiping blade 52 is first brought into contact with the cover mask 26 from one direction. At this time, the front end of the wiping blade 52 comes into contact with the cover mask 26 and moves in a direction along the nozzle plate 22. Thus, the wiping blade 52 wipes the surface of the nozzle plate 22 and collects the residual ink and dirt left on the outer surface of the cover mask 26. The wiping blade 52 is not in contact with the nozzle surface 22*a* and does not touch the nozzle surface 22*a*.

Subsequently, the suction head 61 is moved by the moving mechanism while the suction surface 61*a* provided on the pair of guide portions 72 comes into contact with the cover mask 26 and slides thereon.

At this time, the central portion 71 of the suction head 61 moves in the first direction while the suction surface 61*a* including the opening for the suction port 61*c* faces the nozzle surface 22*a* with a predetermined gap left therebetween. At this time, the processor 81 drives the suction pump 65. Therefore, the suction head 61 sucks the residual ink, dust, and the like from the nozzle surface 22*a* as well as any ink accumulated in or around each of the nozzle holes 31 in the nozzle plate 22 in turn.

The guide portions 72 are movable in the third direction. Accordingly, each guide portion 72 moves in the third direction in accordance with the state of the cover mask 26 when the suction head 61 performs the cleaning of the liquid discharge head 12.

If there is no foreign substance on the cover mask 26, as shown in FIG. 7 ("normal state"), the guide portion 72 will be positioned at the top dead center, and the guide portion 72 and the suction port portion 71 will be flush with the surface opposite to the liquid discharge head 12 as indicated by the two-dot chain line in FIG. 7. When foreign matter or the like is present on the cover mask 26, as shown in FIG. 7 ("abnormal state"), the guide portion 72 moves away from the cover mask 26 along the third direction, and the central portion 71 maintains a position at which it forms a predetermined gap with the nozzle face 22*a*.

Therefore, during the cleaning of the nozzle surface 22*a* of the nozzle plate 22 by the suction head 61, the pair of guide portions 72 move in the third direction following the surface of the cover mask 26 while the predetermined gap is maintained between the suction surface 61*a* and the nozzle surface 22*a*. Accordingly, the positioning of the suction head 61 makes it possible to provide a desired airflow from the suction port 61*c* for permitting removal of the residual deposits on the nozzle surface 22*a*.

According to the liquid discharge recording apparatus 1 comprising a cleaning device 14, the gap between the suction head 61 and the nozzle plate 22 is stabilized. Therefore, the cleaning device 14 can suck the residual deposits of the nozzle surface 22*a* from the suction port 61*c* with a desired airflow. The cleaning device 14 can, hence, improve the cleaning performance for removal of the residual deposits on the nozzle surface 22*a*.

Further, the cleaning device 14 wipes only the cover mask 26 with the wiping blade 52. Therefore, it is possible to prevent the residual deposits on the nozzle surface 22*a* from being pushed into the nozzle holes 31 by the wiping blade 52. Accordingly, the cleaning device 14 can prevent clogging of the nozzle holes 31 of the liquid discharge head 12.

The liquid discharge recording apparatus 1 equipped with the cleaning device 14 can thus suitably remove residual deposits adhered to the nozzle plate 22.

The present disclosure is not limited to the above embodiments and may be embodied in various forms without departing from the spirit and scope of the present disclosure.

While the suction head 61 has been described as having the pair of guide portions 72, it is not limited to this configuration. For example, the guide portions 72 may be integrally connected to form one integrated guide member.

Further, while in the above embodiments, the cleaning device 14 has one suction port 61*c* of the suction head 61 facing along the two nozzle rows 31*a* and 31*b* on the nozzle surface 22*a* of the nozzle plate 22, the configuration of the cleaning device 14 is not limited to this configuration. For example, the suction head 61 may have two suction nozzles provided as the suction ports respectively facing the nozzle rows 31*a* and 31*b*. In such a configuration, the two suction nozzles may still be connected to one common bottle 63, or the two suction nozzles may be connected to different bottles 63. For example, the configuration of the two suction nozzles connected to the different bottles 63 may be preferably adopted if different types of liquids are respectively discharged from the two nozzle rows 31*a* and 31*b*.

The liquid to be discharged is not limited to ink. Liquid other than ink for printing printed on paper or the like may also be discharged. For example, a liquid discharge recording apparatus for discharging liquid other than ink may be a device for discharging a liquid containing conductive particles for forming a wiring pattern of a printed circuit board or the like.

The liquid discharge head 12 may be, for example, a structure in which a vibration plate is deformed by electricity to discharge droplets, or a structure in which liquid droplets are discharged from a nozzle by using thermal energy from a heater.

While in the above embodiments, the liquid discharge recording apparatus 1 is applied to an ink jet recording apparatus, its application is not limited thereto. For example, the liquid discharge recording apparatus 1 can be used for 3D printers, industrial manufacturing machines, medical applications, and the like, and it is still possible to obtain the advantages of the example embodiments, such as improvements in operating efficiencies and/or a reduction in size, weight, or cost of such other apparatus types.

According to the liquid discharge recording apparatus and the cleaning device of the embodiments described above, residual deposits adhered to the nozzle plate can be advantageously removed.

While certain embodiments have been described, these embodiments have been presented by way of example only and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed:

1. A cleaning device, comprising:

a suction port configured to face a nozzle plate of a liquid discharge head with a predetermined gap in a first direction between the suction port and a surface of the nozzle plate having a nozzle therein;

a guide configured to face a cover mask of the liquid discharge head when the suction port faces the nozzle plate, the cover mask covering a periphery of the nozzle plate, the guide being moveable in the first direction away from the cover mask, the guide extending in a second direction beyond an outermost edge of the cover mask, and a portion of the guide extending in the first direction and engaging the outermost edge of the cover mask and a side surface of the cover mask to limit movement of the suction port in the second direction; and an urging member configured to press the guide in the first direction toward the cover mask.

2. The cleaning device according to claim 1, further comprising:

a stopper configured to limit movement of the guide in the first direction away from the cover mask, wherein the guide comprises a protrusion, and the stopper comprises an opening for accepting the protrusion.

3. The cleaning device according to claim 2, wherein the stopper comprises a hole in which the protrusion fits.

4. The cleaning device according to claim 1, wherein the guide is configured to move along a surface of the cover mask in a third direction orthogonal to the first and second directions while the predetermined gap is maintained.

5. The cleaning device according to claim 1, further comprising:

a collection bottle fluidly connected to the suction port.

6. The cleaning device according to claim 1, further comprising:

a suction pump fluidly connected to the suction port.

7. The cleaning device according to claim 1, wherein the guide is configured to directly contact the side surface of the cover mask and position the suction port relative to the nozzle plate in the second direction.

8. The cleaning device according to claim 1, further comprising:

a wiping blade configured to wipe the cover mask.

9. The cleaning device according to claim 8, further comprising:

a holder configured to hold the wiping blade;

a holding member holding the holder and including the suction port;

a suction pump fluidly connected to the suction port; and a collection container configured to collect liquid received via the suction port.

10. A liquid discharge recording apparatus, comprising:

a liquid discharge head comprising a nozzle plate and a cover mask, the nozzle plate including a plurality of nozzles and the cover mask being configured to cover a periphery of a surface of the nozzle plate; and a cleaning device comprising:

a suction port configured to face the nozzle plate with a predetermined gap in a first direction between the suction port and the surface of the nozzle plate, the surface of the nozzle plate having a nozzle therein;

a guide configured to face the cover mask when the suction port faces the nozzle plate, the cover mask covering a periphery of the nozzle plate, the guide being moveable in the first direction away from the cover mask, the guide extending in a second direction beyond an outermost edge of the cover mask, and a portion of the guide extending in the first direction and engaging the outermost edge of the cover mask and a side surface of the cover mask to limit movement of the suction port in the second direction; and an urging member configured to press the guide in the first direction toward the cover mask.

11. The liquid discharge recording apparatus according to claim 10, wherein the cleaning device further comprises:

a stopper configured to limit movement of the guide in the first direction away from the cover mask, wherein the guide comprises a protrusion, and the stopper comprises an opening for accepting the protrusion.

12. The liquid discharge recording apparatus according to claim 11, wherein the stopper comprises a hole in which the protrusion fits.

13. The liquid discharge recording apparatus according to claim 10, wherein the guide is configured to move along a surface of the cover mask in a third direction orthogonal to the first and second directions while the predetermined gap is maintained.

14. The liquid discharge recording apparatus according to claim 10, further comprising:

a collection bottle fluidly connected to the suction port.

15. The liquid discharge recording apparatus according to claim 10, further comprising:

a suction pump fluidly connected to the suction port.

16. The liquid discharge recording apparatus according to claim 10, wherein liquid discharge head is an ink jet head.

17. The liquid discharge recording apparatus according to claim 10, wherein the liquid discharge head is a circulation type head.

18. The liquid discharge recording apparatus according to claim 10, wherein the cleaning device further comprises:

a wiping blade configured to wipe the cover mask.

19. The liquid discharge recording apparatus according to claim 10, wherein the urging member comprises a coil spring.

* * * * *